US005632068A

United States Patent [19]

Riley et al.

[11] Patent Number: 5,632,068

[45] Date of Patent: May 27, 1997

[54] DEVICE FOR SHAPING AND MAINTAINING THE POSITION OF SKIRTS AND COVERS ON SEATING AND UPHOLSTERED FURNITURE

[75] Inventors: Paula Riley, New York; Kenneth V. Stevens, Brooklyn, both of N.Y.

[73] Assignee: Prescient Partners, L.P., New York, N.Y.

[21] Appl. No.: 417,933

[22] Filed: Apr. 6, 1995

[51] Int. Cl.[6] ..... A44B 11/00; A44B 21/00; A44B 13/00; A47G 9/00

[52] U.S. Cl. ..... 24/326; 24/199; 24/198; 24/71.1; 24/545; 297/228.11; 150/158

[58] Field of Search ..... 24/326, 482, 301, 24/520, 528, 129 R, 265 A, 36, 703.1, 18, DIG. 9, DIG. 28, 17 A, 17 B, 198, 176, 186, 130, 199, 716, 316, 318, 321, 71.1, 68 F; 297/224, 225, 228.11; 5/460, 496, 497; 150/158, 164, 165; 108/90; 224/269

[56] References Cited

U.S. PATENT DOCUMENTS

| | | | |
|---|---|---|---|
| 380,695 | 4/1888 | Qurin | 24/35 |
| 544,596 | 8/1895 | Simmons et al. | 24/DIG. 9 |
| 790,150 | 5/1905 | Olson | 24/199 |
| 819,119 | 5/1906 | Bucy | 24/199 X |
| 828,577 | 8/1906 | Sherman | 24/199 X |
| 882,996 | 3/1908 | Clark | 24/198 |
| 894,670 | 7/1908 | Kuze . | |
| 958,249 | 5/1910 | Hirsh | 24/199 X |
| 1,141,018 | 5/1915 | Smith | 24/18 |
| 1,247,373 | 11/1917 | Chaney . | |
| 1,634,619 | 7/1927 | Lake | 24/301 |
| 1,814,978 | 7/1931 | Swanson | 24/68 F |
| 2,210,601 | 8/1940 | Scanlon | 24/301 |
| 2,224,773 | 12/1940 | Shaulson | 24/199 X |
| 2,233,864 | 3/1941 | Edson . | |
| 2,285,714 | 6/1942 | Hirsh | 24/199 |
| 2,292,899 | 8/1942 | Sanford | 24/321 |
| 2,857,643 | 10/1958 | Tomsic | 24/301 X |
| 2,923,014 | 2/1960 | Hume | 297/228.11 X |
| 3,066,435 | 12/1962 | Oddo et al. | 150/158 X |
| 3,099,058 | 7/1963 | Pettingell | 24/709.9 X |
| 3,589,770 | 6/1971 | Kelley | 297/225 X |
| 3,727,272 | 4/1973 | Rhodes | 24/300 |
| 3,749,441 | 7/1973 | Bini | 297/225 |
| 3,959,854 | 6/1976 | Lewis . | |
| 4,026,567 | 5/1977 | Rye . | |
| 4,480,356 | 11/1984 | Martin | 24/545 X |
| 4,632,459 | 12/1986 | Herschlag | 297/440.1 |
| 4,697,847 | 10/1987 | Herschlag | 297/440.1 |
| 4,876,771 | 10/1989 | Givati | 24/298 |
| 4,922,582 | 5/1990 | Flanigan | 24/71.1 |
| 4,955,666 | 9/1990 | Baker | 297/219.1 |
| 5,072,470 | 12/1991 | Lysiak | 5/496 |
| 5,329,654 | 7/1994 | Sherman | 5/14 |
| 5,367,752 | 11/1994 | Petty | 24/301 |
| 5,441,509 | 8/1995 | Vidal et al. | 24/326 X |

*Primary Examiner*—Peter M. Cuomo
*Assistant Examiner*—Robert J. Sandy
*Attorney, Agent, or Firm*—Notaro & Michalos P.C.

[57] ABSTRACT

An assemblage for shaping and maintaining the position of skirts and covers on seating and upholstered furniture comprises an elongated band having a band adjusting member to form the band into a closed loop and to adjust the length of the closed loop; a pleating member capable of being affixed to the band and including a plurality of clips for gathering material of a furniture cover; and a skirt clip capable of being affixed to the band and including a pair of fingers to permit a skirt to be affixed to the elongated band. The above elements can each be used alone or in combination with other elements for securing fabric to furniture.

29 Claims, 11 Drawing Sheets

FIG.12
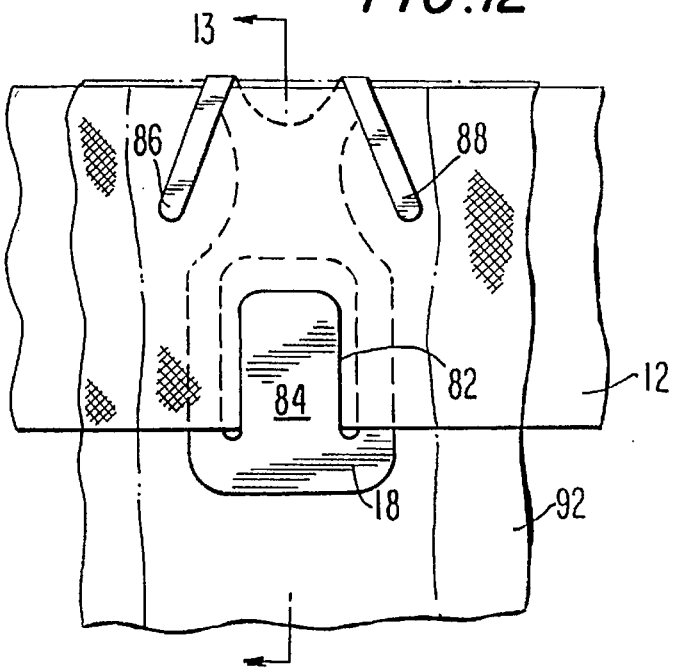
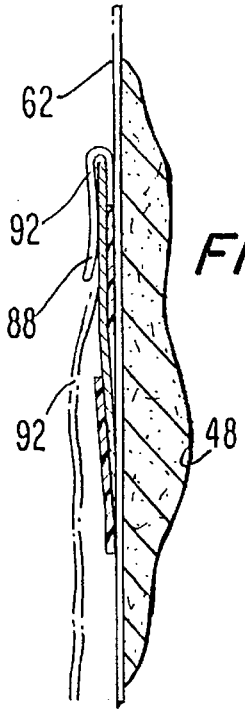
FIG.13
FIG.15
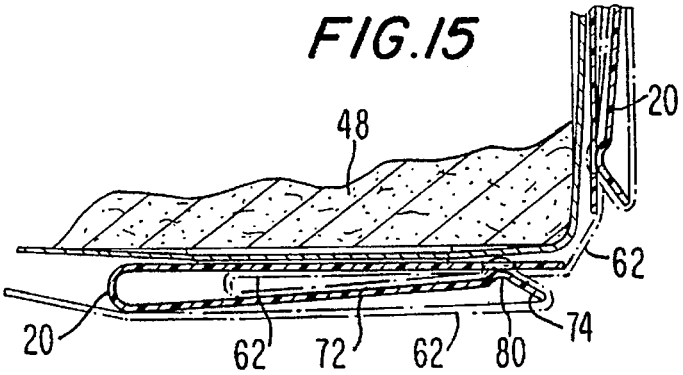
FIG.14
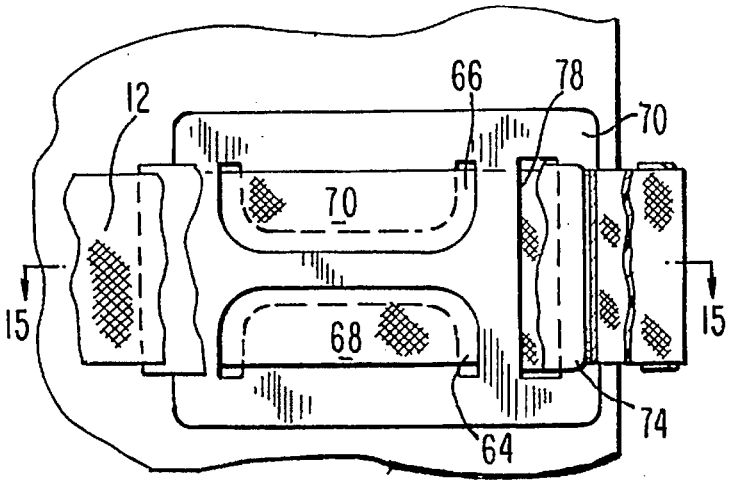

DEVICE FOR SHAPING AND MAINTAINING THE POSITION OF SKIRTS AND COVERS ON SEATING AND UPHOLSTERED FURNITURE

BACKGROUND OF THE INVENTION

1. Field of the Invention

The present invention relates generally to devices for shaping and maintaining the position of skirts and covers on seating and upholstered furniture. More specifically, the present invention relates to a device which includes an elongated band, a band adjusting member to form the band into a closed loop and to adjust the length of the closed loop, a pleating member to gather material of a throw cover, a skirt clip to connect a skirt to the elongated band and a corner fabric gathering member to gather material of a furniture cover.

2. Discussion of the Related Art

The use of fabric furniture covers on upholstered furniture has long been very popular. Furniture covers vary in size from, for example, a 100" by 90" cover for chairs to a 100" by 170" cover for large sofas. Conventionally, after the furniture covers have been loosely placed on, for example, a sofa, the user will hand tuck the fabric cover into the spaces between the seat cushion and the back and between the seat cushion and the arms at each side of the seating perimeter. To maintain the proper and desired position of the furniture cover on the sofa, the present inventors have heretofore developed a stabilizing device that permits the cover to be initially tucked in place on the upholstered furniture in a desired position and thereafter prevents its relative movement with respect to the upholstered furniture during the normal use without causing damage to the furniture cover. The stabilizing device is an elongated member having a V-shaped cross-section and is disclosed in Applicants' copending application Ser. No. 08/270,057, filed on Jul. 1, 1994.

Besides maintaining the position of the furniture cover with respect to the sofa, it is also desirable to gather, shape and/or pleat the fabric of the furniture cover, especially in front of the arm sections of the sofa and at the corners of the sofa, so as to enhance the decorative appearance of the furniture. In addition, skirts of approximately 11" in height are typically sold with the furniture cover so that the elasticized skin can be placed about the base of the furniture with the bottom of the skirt falling just above the floor level.

To properly shape or form the pleats in the furniture cover, especially in front of the arms of the piece of furniture, professional decorators will spend significant time and effort to perfectly sculpt the fabric and will often use T pins, straight pins or screw pins (as shown in FIG. 24) or even staples to maintain the position of the fabric. These pins are inserted through the fabric of the cover and are anchored into the material of the sofa. Unfortunately, this method is not only quite time consuming, but also damages and will eventually destroy the material of the slip cover and the material of the furniture. The typical, non-professional user is more likely to form these pleats by simply tucking the furniture cover material behind the elasticized skirt. However, this method of shaping often results in a sloppy, disheveled appearance. Additionally, after the furniture cover has been tucked behind the skirt, problems quickly arise due to the normal movement of the person, e.g., sitting, moving about and/or getting up. This problem is especially apparent in front of the arms of the piece of furniture and near the corners, because the furniture cover becomes wrinkled, bunched up and out of place. Accordingly, to maintain the proper desired position of the furniture cover, the typical user must continuously reform the pleats, as best as he or she can, and retuck the furniture cover below the skirt.

In one embodiment of the prior art, after the pleats have been formed, an elasticized skirt is placed about the base of the piece of furniture. The skirt must be available in separate sizes for a sofa, love seat, chair and an ottoman so that it wilt have enough elasticity to be secured about the respective piece of furniture. However, especially with respect to a long sofa, the skirt has a tendency to sag over time, particularly in the front middle portion of the skirt. Unfortunately, this is the most noticeable portion of the skirt. Pins can, of course, be used to maintain the position of the skirt, but again with repeated use this risks making holes in the furniture cover and the furniture. In addition, during normal use stresses are applied to the pins causing them to loosen and eventually become dislodged. Obviously, when a pin becomes dislodged it immediately becomes a safety hazard, especially for small children and people walking near the furniture without shoes.

It is therefore an object of the present invention, to provide a device that (1) permits a cover to be decoratively shaped on a piece of furniture and (2) also permits a skirt to be attached to and draped from the base portion of the furniture, so that both the cover and the skirt, with respect to the furniture, are maintained in a stable position without damaging the cover, skirt or the furniture.

It is another object of the present invention, to provide a device that comprises a minimal number of parts which are easy to manufacture.

It is a still further object of the present invention to provide a device which is simple to use and safe and reliable in operation.

SUMMARY OF THE INVENTION

In accordance with a preferred embodiment demonstrating further objects, features and advantages of the present invention, the device includes an elongated band having a first end and a second end. A band adjusting member is utilized so that the band may form a closed loop which can be adjusted to a predetermined length. A pleating member is selectively connected to the elongated band and includes a plurality of clips which can be used to gather and shape the furniture cover material. A skirt clip may also be selectively connected to the elongated band and has a pair of downwardly depending fingers so that the skirt can be connected to the band.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein:

FIG. 12 is a plan view of a skirt clip in accordance with FIG. 4 being connected to the elongated band and to a skirt;

FIG. 13 is a sectional view taken along lines 13—13 of FIG. 12;

FIG. 14 is a plan view of a corner fabric gathering member being connected to the elongated band and having the furniture cover fabric being gathered within the clip of the corner fabric gathering member;

FIG. 15 is a sectional view taken along lines 15—15 of FIG. 14;

DETAILED DESCRIPTION OF THE PRESENTLY PREFERRED EXEMPLARY EMBODIMENTS

Figure 27:
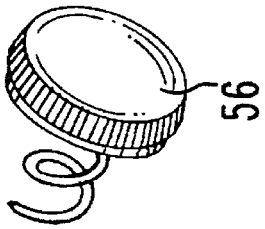
FIG. 27 PRIOR ART
FIG. 27 is a respective view of a pin according to the prior art.
Figure 1:
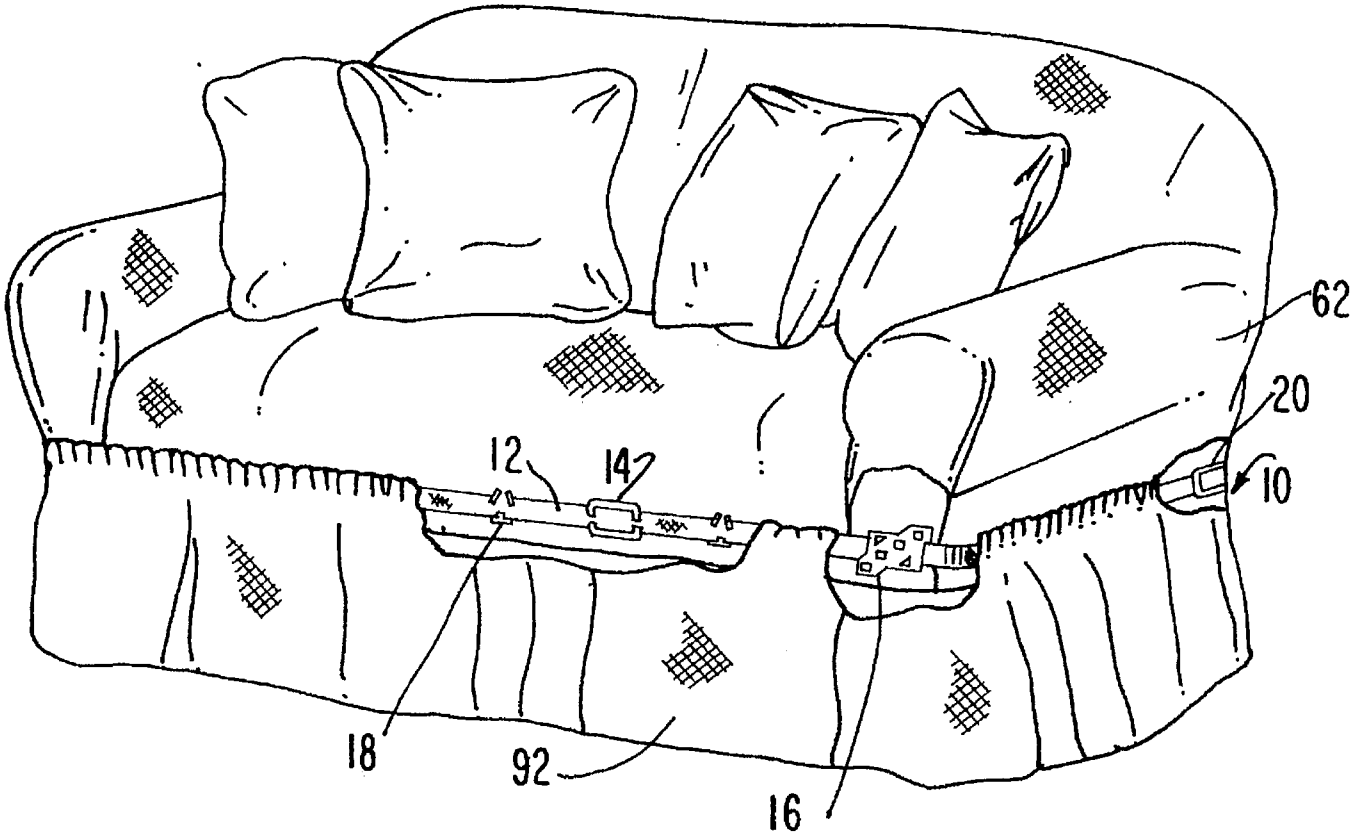
FIG. 1 is a perspective view, partially broken away, of the device according to the present invention.

Referring now to FIG. 1, a device 10 for maintaining the position of skirts and covers on seating and upholstered furniture is illustrated. The device includes an elongated elasticized band member 12, a band adjusting member 14, a pleating member 16, a skirt clip 18 and a corner clip 20.

The elongated band 12 has a first end 22 and a second end 24, as illustrated in FIGS. 6 through 9, and is preferably made of an elastic material. The material has an elasticity sufficient to ensure that the band, when formed into a closed loop, will fit snugly about the seating or upholstered furniture, in a substantially horizontal plane, without having a tendency to sag, even when used to support the weight of a skirt. The elasticity will of course vary depending upon the dimensions of the elongated member and the material of construction. The appropriate elasticity can be easily determined by one skilled in the art. In a preferred embodiment, the band 12 has a width a (see FIG. 6) equal to about 2.5". The band will typically come in at least two different sizes. For example, one size of approximately 144" for sofas and love seats and a second size of approximately 72" for chairs and ottomans. Of course, other sizes could be accommodated for extra large sofas or, very small ottomans.

Figure 2:
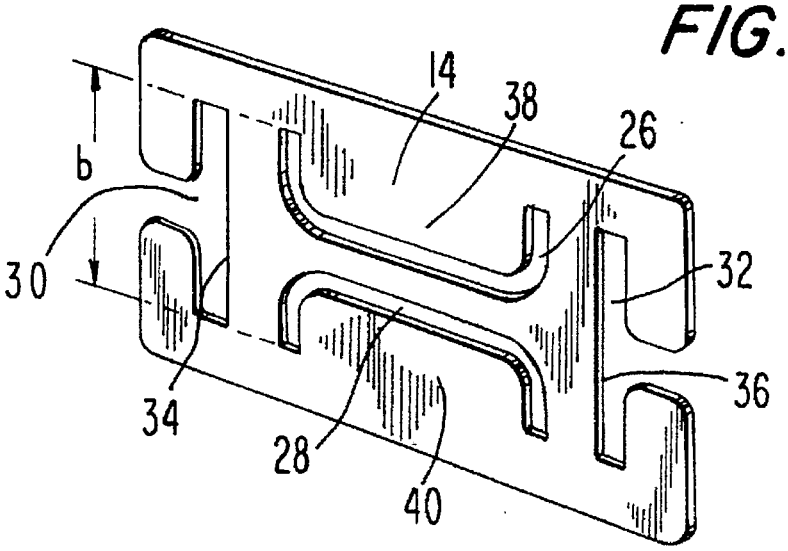
FIG. 2 is a perspective view of a band adjusting member according to the present invention.

The band adjusting member 14 is illustrated in FIG. 2 is a plate which has a planar shape and includes a pair of U-shaped slots 26, 28 and a pair of T-shaped slots 30, 32. Each of the slots 30, 32 have a cross friction with a width b which is slightly greater than the width a of the elongated band member 12. The distance from the distal ends of the legs of the U-shaped slot 26 to the distal ends of the legs of the U-shaped slot 28 is also of a distance b. The U-shaped slots 26, 28 permit the elongated band 12 to be connected to the band adjusting member 14 (See FIG. 6). The T-shaped slots 30, 32 have leg portions that open at a narrow one of the edges of the plate. The slots 30, 32 permit the elongated band 12 to be looped about an internal base surface 34, 36 of the T-shaped slots 30, 32 respectively, so that the length of the closed loop can be adjusted. The slots 26, 28 form slot means between the cross portions of the T-shaped slots 30, 32, in the plate.

Figure 7:
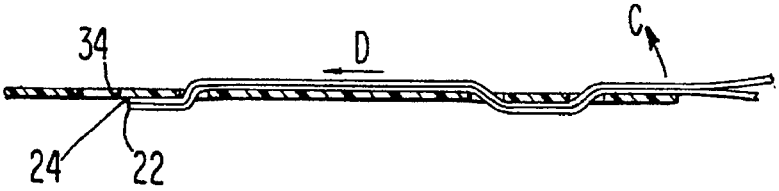
FIG. 7 is a sectional view taken along lines 7—7 of FIG. 6, showing a first step in the process of adjusting the length of the closed loop of the elongated band.

Referring now to FIGS. 6–9, the steps for forming the closed loop from the elongated band are illustrated. The band is folded in half so that the first end 22 and the second end 24 of the band face one another. Thereafter, they are threaded into the band adjusting member 14 in a manner illustrated by arrow D in FIG. 6. Accordingly, the first and second ends 22, 24 will first pass into T-shaped slot 32 and then can be threaded behind the flaps 38, 40 of the U-shaped slots 26, 28, respectively, positioned just before internal edge 34. The final position is illustrated in FIG. 7.

Figure 8:
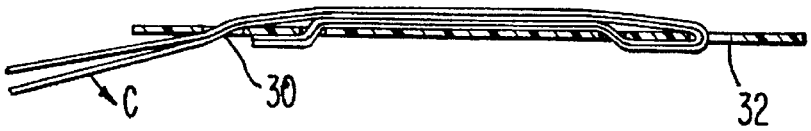
FIG. 8 is a sectional view showing a second step in the process of adjusting the length of the closed loop of the elongated band.
Figure 9:
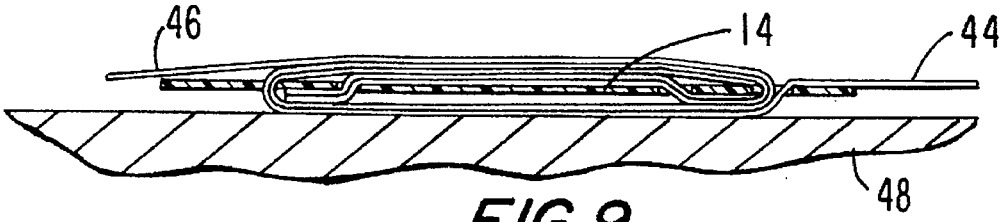
FIG. 9 is a sectional view of the band adjusting member after the length of the closed loop has been adjusted.

The remaining portion of the now formed loop portion 42 of the band 12 is then pivoted in the direction indicated by arrow C in FIG. 7. The loop is then threaded through T-shaped slot 30 as illustrated in FIG. 8. The loop portion 42 can then again be pivoted in the direction indicated by arrow C, so that the loop portion can be threaded through T-shaped slot 32 as illustrated in FIG. 9. If the desired loop length has then been achieved, the one end of the loop 44 can then be separated from the other end of the loop 46 so that they now each extend in opposite directions, as illustrated in FIG. 9. The elongated band 12 has now been formed into a closed loop having the desired length. The amount of the loop adjustment is effectively limited by how much material can pass through the T-shaped slots 30, 32. The distance between the internal walls is, in one embodiment, about 4", and the width of slots 30, 32 is about ⅜", so that the band adjusting member 14 can typically adjust the length of the loop up to about 36". However, it is clear the dimension of the T-shaped slots can be varied so that the range of variation for the loop length can be either greater or smaller than one yard. After the desired loop length is obtained, the elongated band 12 and the band adjusting member 14 are placed about the piece of furniture at the desired height about which the top of the skirt is to be draped from the piece of furniture 48. The band adjusting member 14 is designed so that the band material can be wrapped around band adjusting member 14 without significantly increasing the thickness of the assembled band and band adjusting member 14. Therefore, when the skirt is connected to band 12, the skirt will not appear to bulge outwardly as it passes over member 14. However, for aesthetic purposes, it is preferred that member 14 be placed along a side of the furniture that is typically not visible to the user.

Figure 3A:
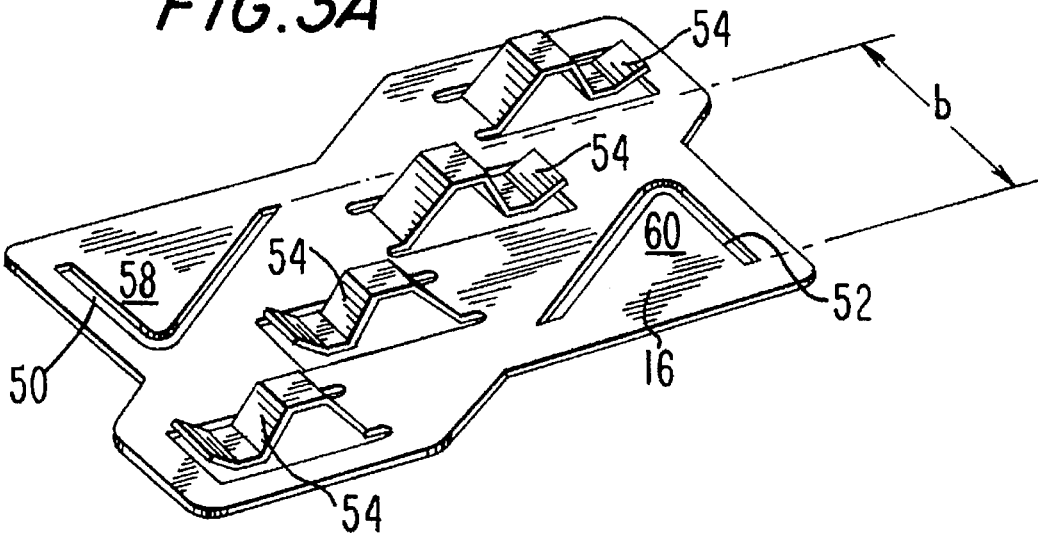
FIGS. 3A and 3B are perspective views of a pleating member according to the present invention.
Figure 3B:
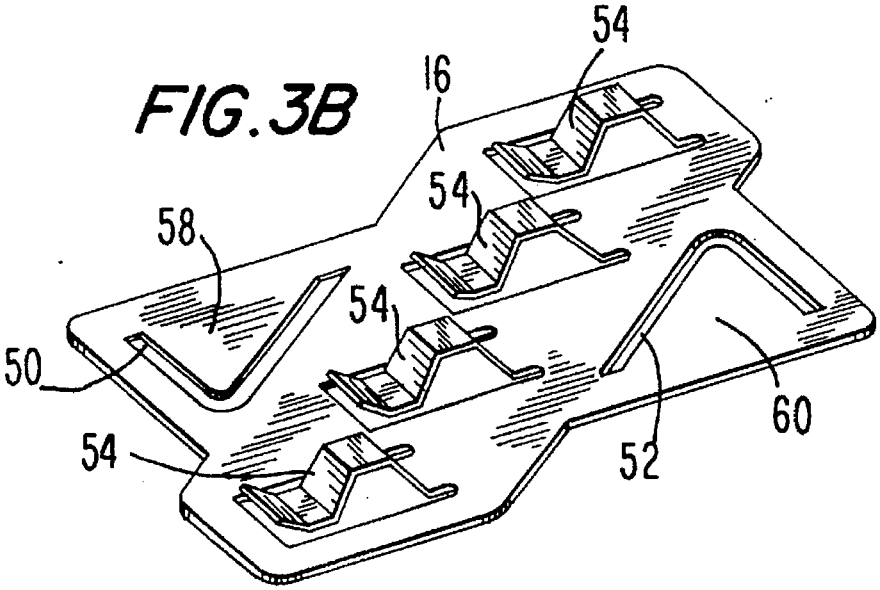
Figure 10:
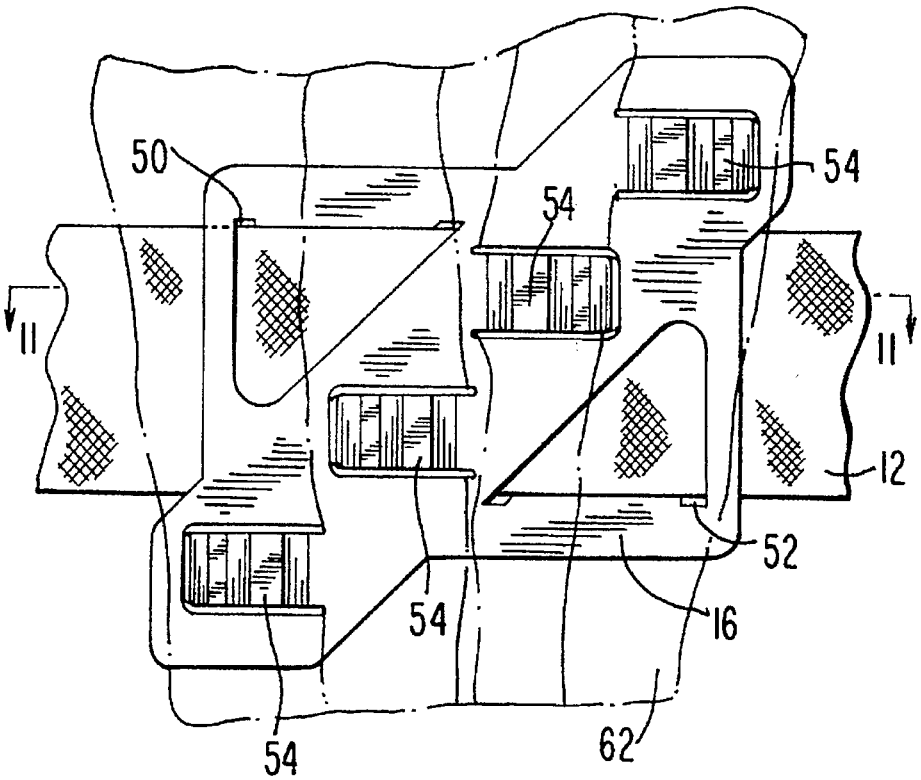
FIG. 10 is a plan view of the pleating member being connected to the elongated band and gathering material from a furniture cover.
Figure 11:
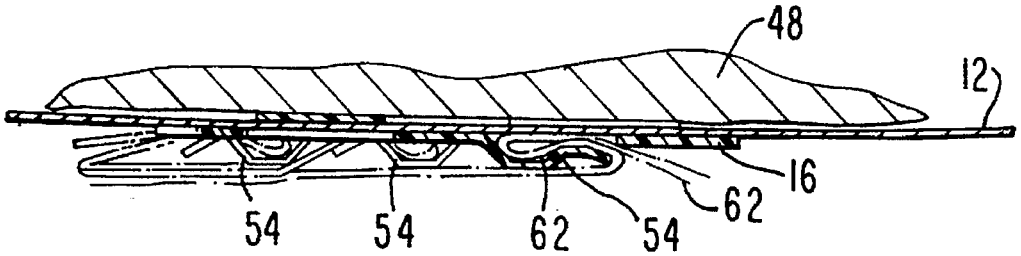
FIG. 11 is a sectional view taken along line 11—11 of FIG. 10.

A pleating member 16 is illustrated in FIGS. 3A and 3B. It has a pair of V-shaped slots 50, 52 which permit the pleating member to be slipped onto band 12 as illustrated in FIGS. 10 and 11. Pleating member 16 also includes a plurality of clips 54, which can be, as illustrated in FIG. 3B, all oriented in the same direction or, as illustrated in FIG. 3A, oriented in opposite directions. Of course, each clip 54 can be oriented in any direction depending on the desired pleating configuration. In addition, each clip need not be unitary with respect to the pleating member and can be made separately and thereafter attached to pleating member by, for example, a snap-on type of connection so that each clip can be oriented in any direction. Each clip 54 is utilized to gather material of the furniture cover 62 so that the furniture cover material can be shaped or sculpted in a manner desired by the user. The clip 54 is made of a sufficiently resilient material so that the furniture cover material 62 may be inserted under the clip by bending it to an open, unstable position and, after the material has been gathered and positioned under the clip, the clip is then released to its naturally closed or stable position so as to secure the material in place. Typically, a pair of pleating members are connected to the band 12 in a position which is in front of the arm portions of the furniture. As illustrated in FIGS. 1B, 10 and 11, the pleating members serve to form a plurality of decorative pleats in the furniture cover material 62.

The material of the band 12 is disposed on the side of the notch-shaped flaps 58, 60 facing the clips 54 with the remaining portion of the band 12 being disposed on the side of the pleating member which is disposed opposite that of the pleating clips 54. The distance between the distal ends of the legs of the V-shaped slot 50 to the distal ends of the legs of the V-shaped slot 52 is preferably distance b so that the elongated band 12 will fit snugly within the V-shaped slots 50, 52 of the pleating member, as illustrated in FIG. 10.

Figure 5:
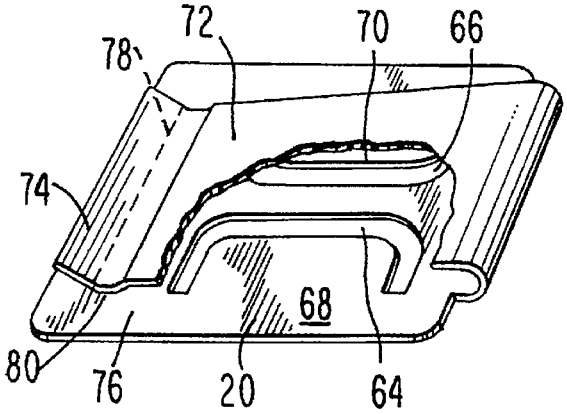
FIG. 5 is a perspective view, partially broken away, of a corner fabric band adjusting member according to the present invention.
Figure 6:
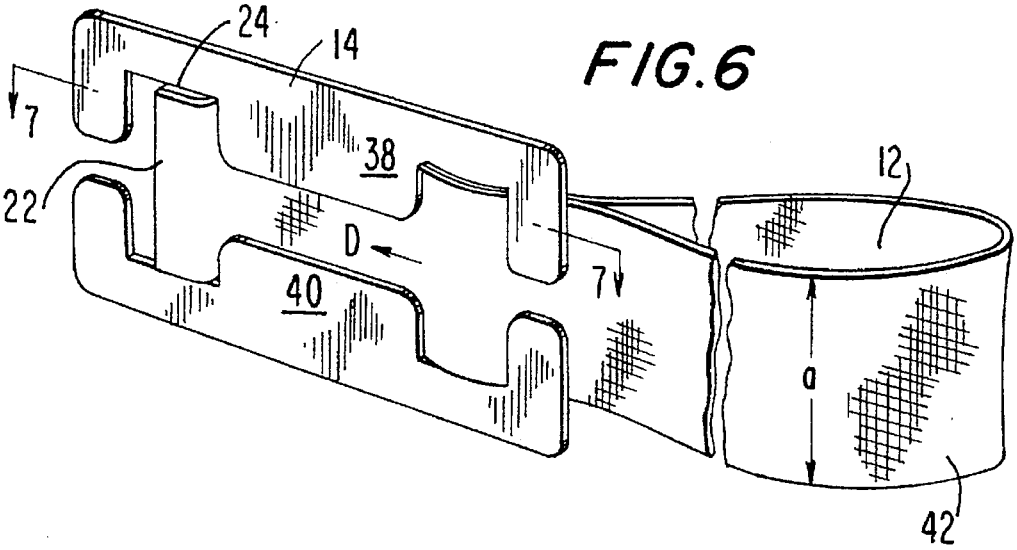
FIG. 6 is a perspective view of the band adjusting member illustrated in FIG. 2 having a first end and a second end of an elongated elasticized band connected thereto.

Corner fabric gathering member 20 is illustrated in FIG. 5 and includes a pair of U-shaped slots 64, 66. The U-shaped slots 64, 66 define flaps 68, 70, respectively, as illustrated in FIG. 5. The corner member 20 is slipped onto band 12 by simply threading it through the U-shaped slots as illustrated in FIG. 14. The distance from the distal ends of the legs of the U-shaped slot 64 to the distal ends of the legs of the U-shaped slot 66 is distance b. Corner fabric gathering member 20 includes a clip arm 72. The distal end 74 of the arm 72 curves outwardly away from a planar base surface 76 of the corner fabric gathering member 20 to form a handle for the clip arm 72. The base portion 76 also includes a rectangular shaped slot 78 which receives a curved portion 80 of arm 72 so that the furniture cover material 62 can be gathered and securely held within arm 72, as illustrated in FIG. 15. Arm 72 is made of a resilient material similar to clip 54. For the sake of clarity, the furniture cover 62 has not been shown in FIG. 14 and band 12 has not been shown in FIG. 15.

Figure 4:
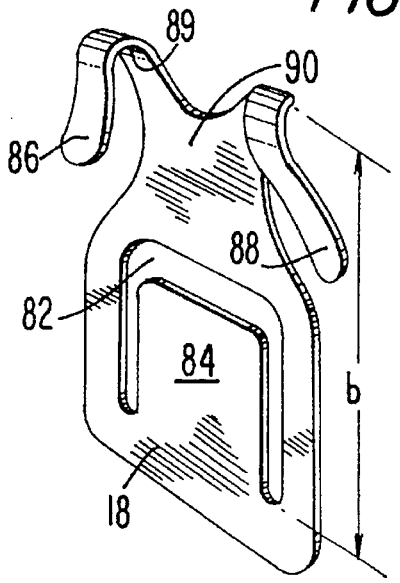
FIG. 4 is a perspective view of a skirt clip according to the present invention.

The skirt clip 18, illustrated in FIGS. 4, 12 and 13, includes a U-shaped slot 82 which defines a flap 84. In the illustrated embodiment, skirt clip 18 also includes a pair of downwardly depending fingers 86, 88. Band 12 is selectively connected to skirt clip 18 by threading the lower edge of band 12 into the U-shaped slot 82, and an upper edge against the base surface 90 of the skirt clip and under the downwardly depending fingers 86, 88. The distance from the distal ends of the legs of the U-shaped slot 82 to an internal wall surface 89 disposed between the junction of fingers 86, 88 and base surface 90 is distance b.

The skirt clip 18 is used to join together the skirt member 92 and band 12. In the preferred embodiment, the furniture cover 62 is placed over the sofa 48 and the band 12 positioned around and over the furniture cover. The skirt 92 is then connected to the skirt clip by placing the top portion of the skirt 92 between the base portion 90 of the skirt clip and the downwardly depending fingers 86, 88. Accordingly, only the finger portions 86, 88 of the skirt clip are visible when the covering of the furniture is completed. To minimize the visibility of the fingers they are preferably made from a transparent material. In addition, the fingers of the clip 18 are made of a sufficiently resilient material to permit the skirt 92 to be inserted under the fingers while still securely attached to the skirt clip 18 and the band 12. As illustrated in FIG. 1, a plurality of skirt clips are spaced along the length of the band 12 at sufficient intervals to ensure that the skirt 92 is uniformly connected to band 12 so that no portion of the band will be visible. The clips are preferably spaced at about two feet intervals from one another. The appropriate spacing may readily be determined by the user.

The use of the device according to the present invention will be described below with reference to FIGS. 1 and 6 through 15. The user first places the furniture cover 62 over the furniture. The cover is then tucked into the spaces between the adjacent cushions and the cushions and the furniture itself. As discussed above, it is preferred that the user will use a stabilizing device as described in Applicants' abovementioned copending application to secure the furniture cover about the cushions. Once the stabilizing device and the cover have been tucked into the desired position, the user then proceeds to shape and maintain the position of the furniture cover and skirt in accordance with the invention.

The first step is to connect the elongated band 12 to the band adjusting member 14 in the manner described above so as to form a closed loop of the desired length. The elongated band is then horizontally placed about the piece of furniture at the desired height, i.e., at the location where the top of the skirt will be positioned, as illustrated in FIGS. 1 and 9.

A pleating member 16 is then connected to band 12 in a position corresponding to the arm portions of the furniture. The furniture cover material 62 is gathered within the clips 54 to form pleats as it drapes down from the arm portion. Since the furniture cover material 62 is beneath the elongated band 12, to form the desired pleats, the user must lift out an amount of the furniture cover 62 sufficient to be gathered within clips 54 to form the pleats. Another pleating member 16 is connected to the band 12 in a position for forming the pleats in front of the other arm of the furniture.

If desired, a pair of corner fabric gathering members 20 can be used at each of the back corners of the piece of furniture. A pair of corner gathering members 20 connected to band 12 at each of the rear corners is illustrated in FIG. 15. At each corner, one corner member 20 is placed on the side and another corner gathering member 20 is placed in the back of the furniture. The furniture cover 62 can then be gathered and placed within the arm portion 72 of the clip by simply opening up the arm at distal end 74 and placing the desired amount of material within the clip. Once the material has been properly shaped the distal end 74 of the arm is released and the arm 72 will naturally close to its stable position. The corner member 20 securely holds the fabric 62 within the clip. The same process can then be repeated for the opposite back corner of the piece of furniture. The use of the corner fabric gathering members 20 is optional. The material may be simply gathered and shaped by placing it beneath the band 12, which is snugly connected to the furniture. Because the loop length of the band can be adjusted, the tension in the band is sufficient to maintain the shape of the furniture cover in this less conspicuous area of the furniture.

The next step is to place a plurality of skin clips 18 at spaced intervals on band 12. Once the clips 18 are connected to the band, the skin 92 is then connected to the skin clip by placing the top portion thereof between the upper portion of band 12 which is adjacent to the base portion 90 of the skirt clip and the downwardly depending fingers 86, 88. Once the skirt 92 has been connected to the clips 18, the process of shaping and maintaining the position of a skirt and the cover is completed. This entire process can be accomplished in a very brief period, e.g., fifteen to twenty minutes, as compared to the hours that professional decorators generally need to precisely position the furniture cover and skirt.

If after an extended period of time the length of the closed loop of the elongated band 12 needs to be adjusted, this adjustment can be made without removing band 12 from the piece of furniture. All that is required is the removal of the skirt from the area where the band adjusting member 14 is attached to the band 12. Referring now to FIG. 9, the band adjusting member 14 need only be rotated in a clockwise direction to increase the tension on the band member. After each 180° rotation, end 44 of the band 12 should be passed through the T-shaped slot 32. Conversely, to loosen the tension on the band member 12, the band member 14 is simply rotated in a counter-clockwise direction. In this case, after each 180° turn end 44 is removed from the T-shaped slot 32.

The pleating member 16, skirt clip 18 and corner fabric gathering member 20 can all be slipped directly onto the closed loop of the elongated band in the desired position, without having to thread an end of the elongated band through each member before the loop is formed. In addition, once each member is placed on band 12, its position with respect to the band 12 can be adjusted by sliding the member with respect to the band 12, without removing the member from the band. The band 12 is preferably made of an elastic material to facilitate the tucking of the furniture cover 62 beneath the band and to facilitate the placement of the members 16, 18, 20 onto the band.

Figure 17:
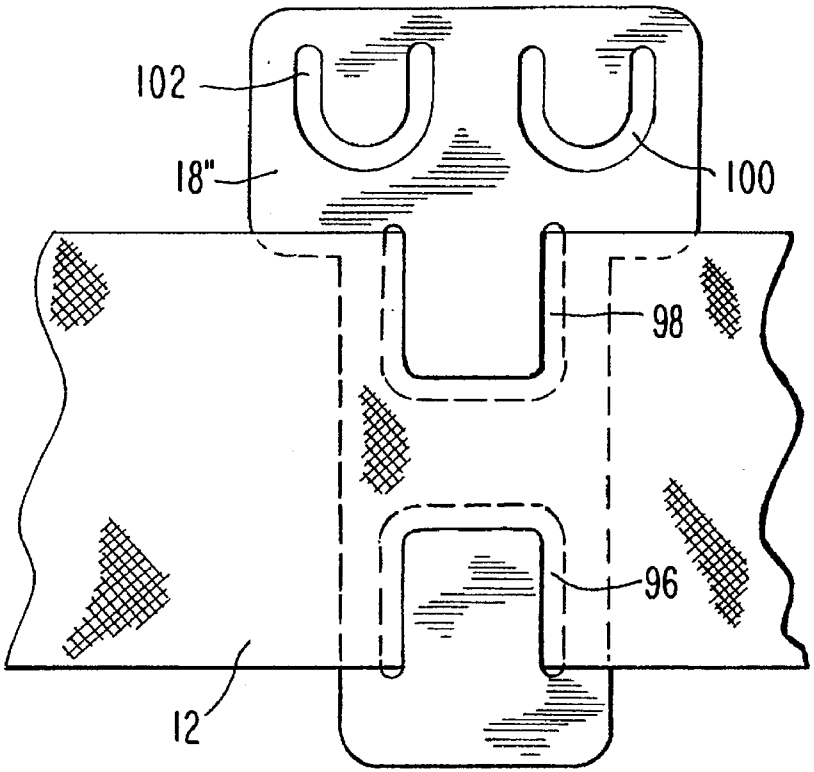
FIG. 17 is a plan view of a second alternative embodiment of a skirt clip according to the present invention.
Figure 16:
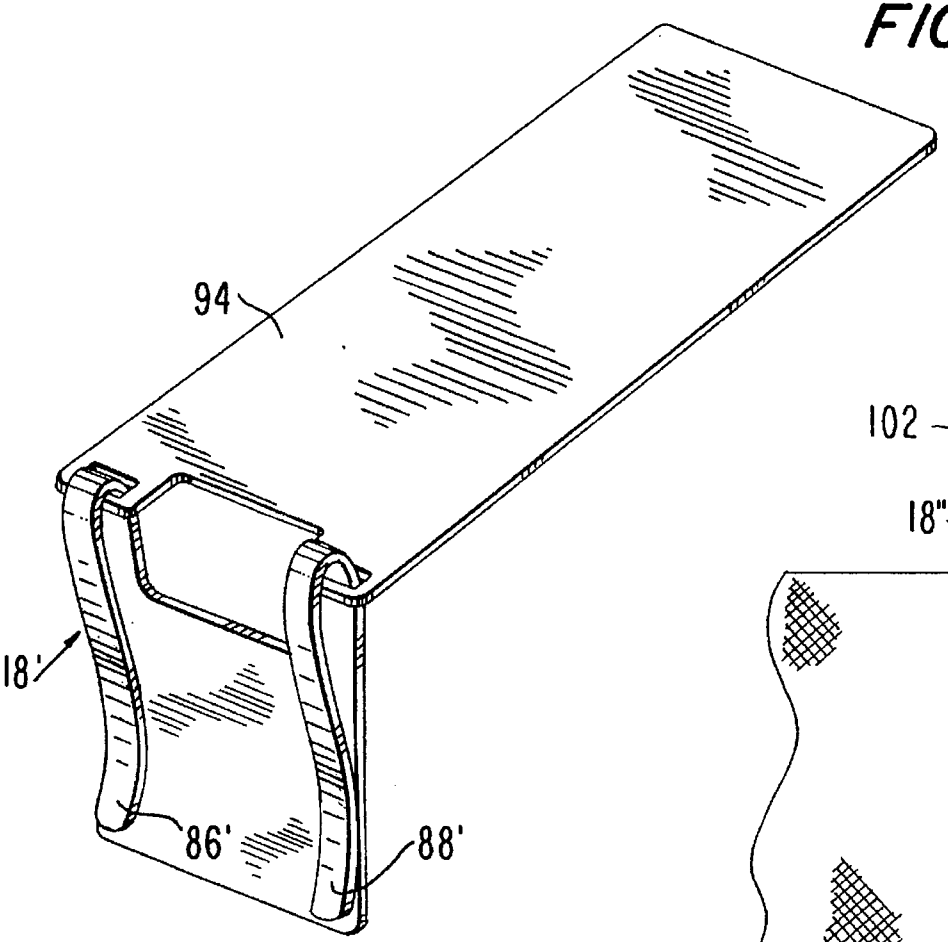
FIG. 16 is a perspective view of an alternative embodiment of a skirt clip according to the present invention.
Figure 18:
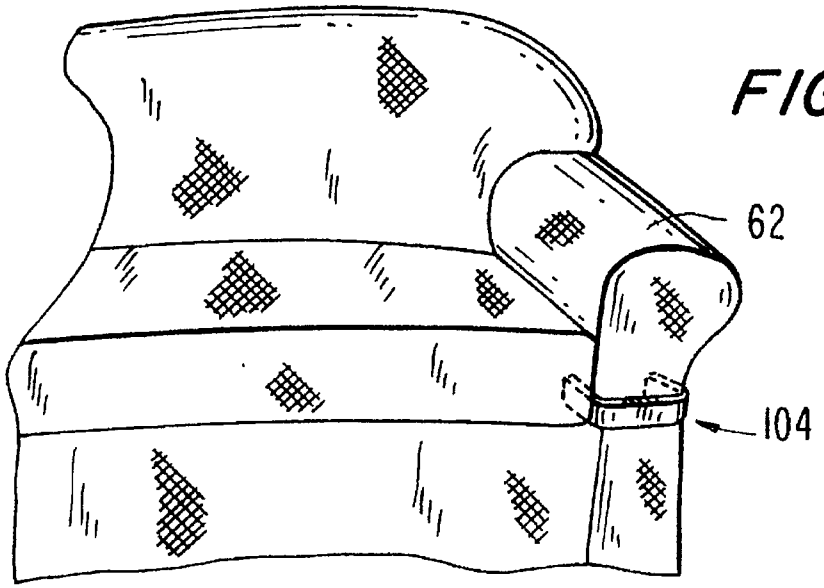
FIG. 18 is a perspective view of a U-shaped clip being attached to the arm of a piece of furniture according to the present invention.

The band adjusting member 14, pleating member 16, skirt clip 18 and corner fabric gathering member 20 are preferably made of a plastic material but all could be made from metal. In addition, the shapes of the various clip members of the present invention can vary. For example, referring now to FIG. 16, the skirt clip 18' can be hingedly connected to a tongue 94, which can be inserted under the sofa cushion to hold it in place. The skirt 92 can be inserted below the fingers 86', 88'. In this embodiment, skirt clip 18' would not be required to be attached to an elongated band. Another embodiment is illustrated in FIG. 17, and includes a skirt clip 18" that has an essentially planar body that includes two U-shaped slots 96, 98 so that clip 18" can be connected to band 12. In addition, clip 18", has an upper extending portion that includes an additional pair of U-shaped slots 100, 102. These slots 100, 102 permit a skirt to be threaded into clip 18" without the use of any outwardly projecting finger portions. The skirt can be threaded into the clip 18" in a manner that is similar to how band 12 is threaded into upper U-shaped slot 98.

Figure 21:
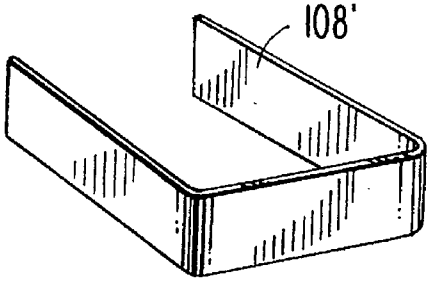
FIG. 21 is a perspective view of an alternative embodiment of the U-shaped clip according to the present invention.
Figure 19:
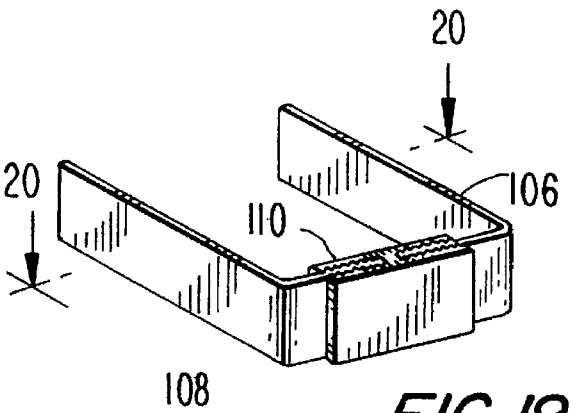
FIG. 19 is a perspective view of a U-shaped clip according to the present invention.
Figure 20:
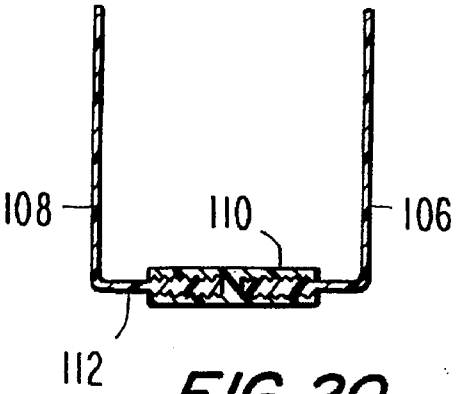
FIG. 20 is a sectional view taken along lines 20—20 of FIG. 19.

FIGS. 18–21 show a U-shaped clip 104 that can be attached about the arm portion of the furniture. The U-shaped clip 104 can include a pair of L-shaped leg portions 106, 108 which are adjustably, telescopingly received within an H-shaped base member 110. The clip 108 can be adjustably attached to the arm section of the furniture to retain the furniture cover 62 between the furniture and the clip 108. Additionally, the facing portion 112 of the clip 108 can include one or more pleating clips (not shown) so that the clip 108 can be attached to the arm and the furniture cover 62 can be placed on the outside of clip 108 so that one or more decorative pleats can be formed in the furniture cover 62. As shown in FIG. 21, clip 108' can be made of a single piece whose legs are biased inwardly so that clip 108' be directly connected to the arm portion of the furniture.

Figure 22:
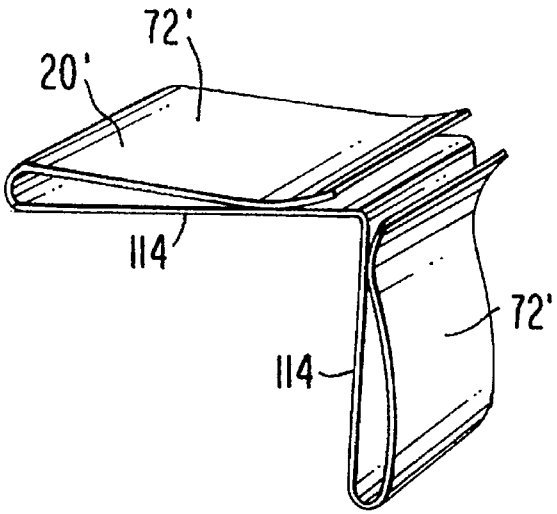
FIG. 22 is a perspective view of an alternative embodiment of a corner fabric gathering member according to the present invention.

An alternative form of the corner clip 20' is illustrated in FIG. 22. In this embodiment the clip includes a base portion 114 which is bent at a right angle and includes two arm portions 72'. The throw cover 62 can then be gathered and placed within each arm portion 72' of the clip. Once the material has been properly shaped, the distal ends 74 of the arms are released and the arms 72' will naturally close to their stable position. The corner member 20' would securely hold fabric 62 within the clip. It should be noted that clip 20' is not attached to a band member and simply hangs with the furniture cover from the rear corners of the furniture.

Figure 23B:
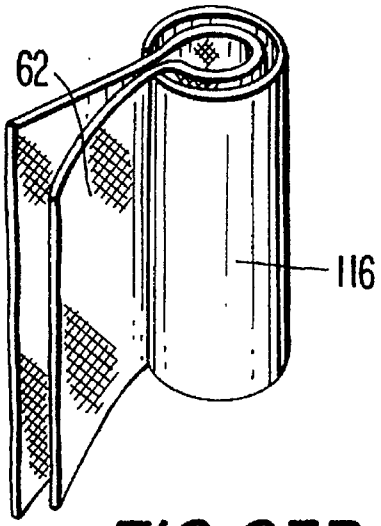
FIG. 23A and 23B are perspective views of a tubular clip according to the present invention.
Figure 23A:
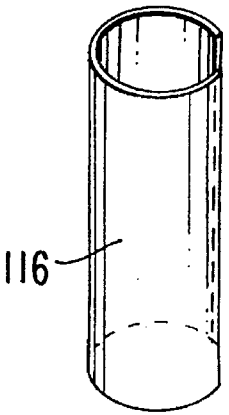

FIGS. 23A and 23B illustrate an alternate embodiment of a clip 116. This clip can be comprised of a tubular member having an axial slit along its entire length. The fabric 62 can be gathered and placed within clip 116 as illustrated in FIG. 23B.

Figure 24B:
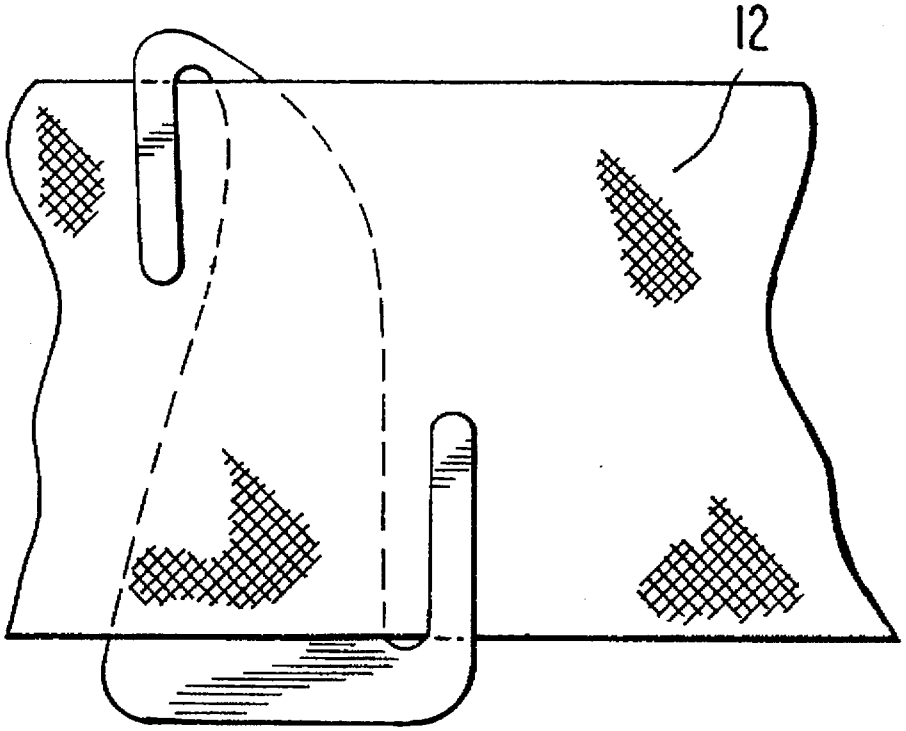
FIGS. 24A and 24B illustrate an alternative embodiment of the skirt clip having one downwardly depending finger.
Figure 24A:
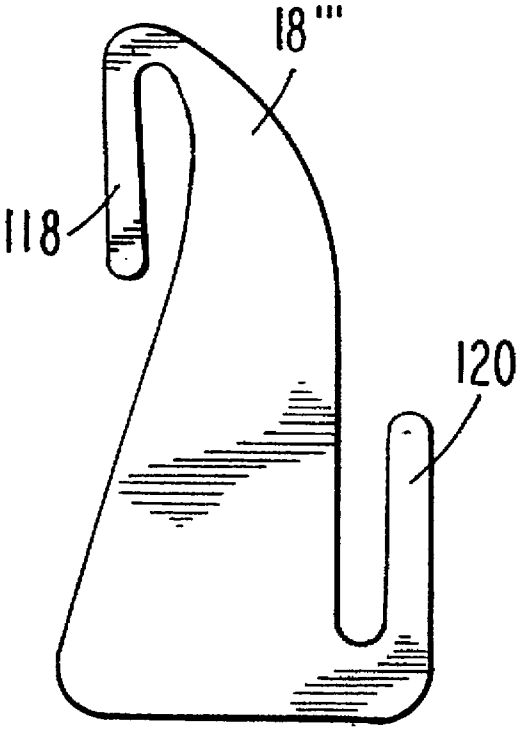
Figure 25A:
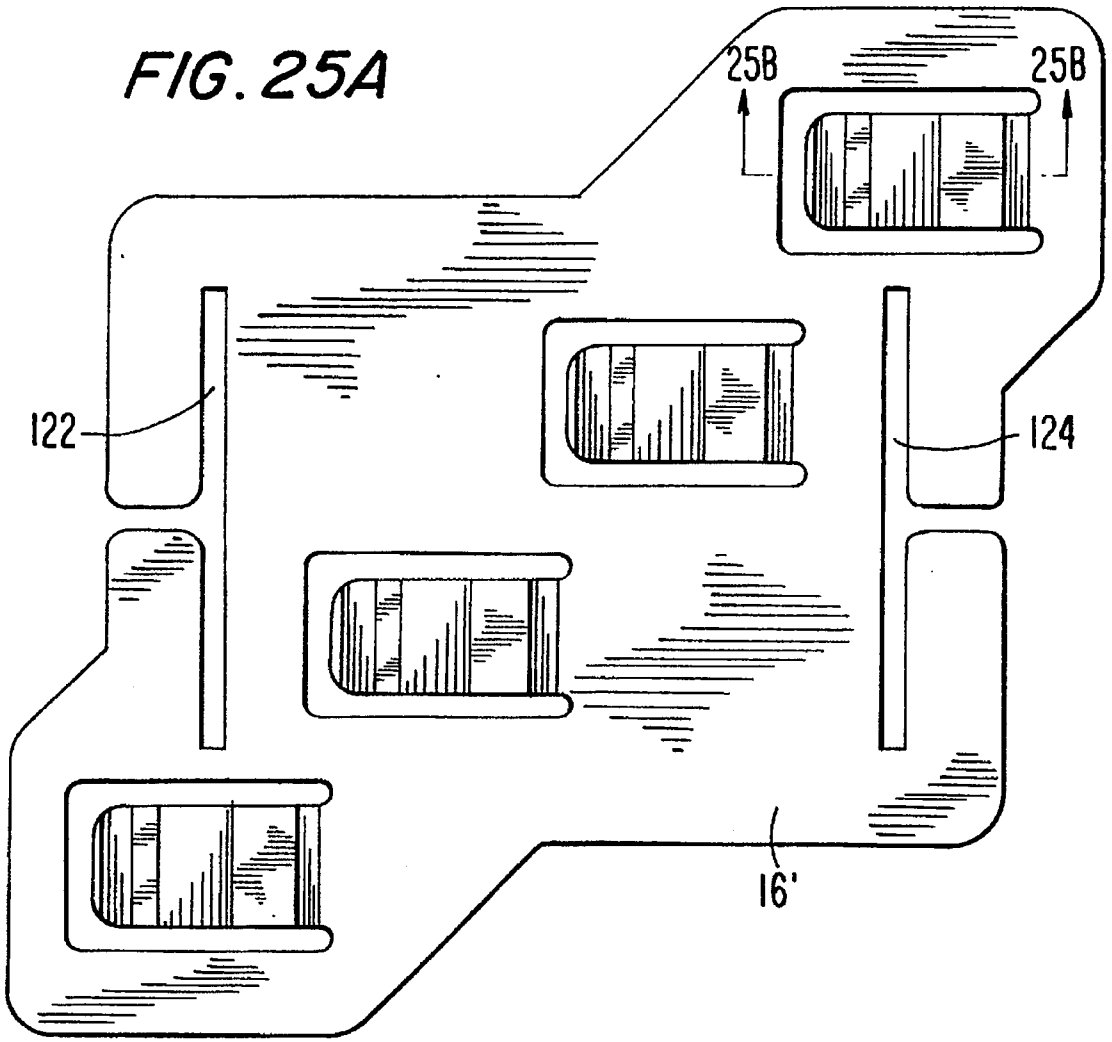
FIGS. 25A and 25B show a plan view and a partial side sectional view of an alternate embodiment of a pleating member according to the present invention.
Figure 25B:
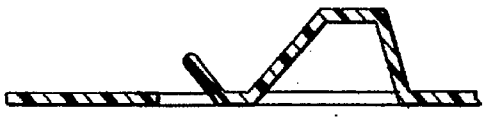

FIGS. 24A and 24B illustrate an alternate embodiment of a skirt clip 18'" which has only one downwardly depending finger 118. FIG. 24B illustrates how skirt clip 18'" can be attached to a band 12 by the use of finger 118 and second finger 120.

Figure 26B:
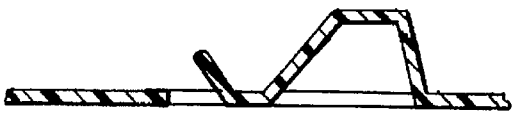
FIGS. 26A and 26B show a plan view and a partial side sectional view of another alternate embodiment of a pleating member according to the present invention.
Figure 26A:
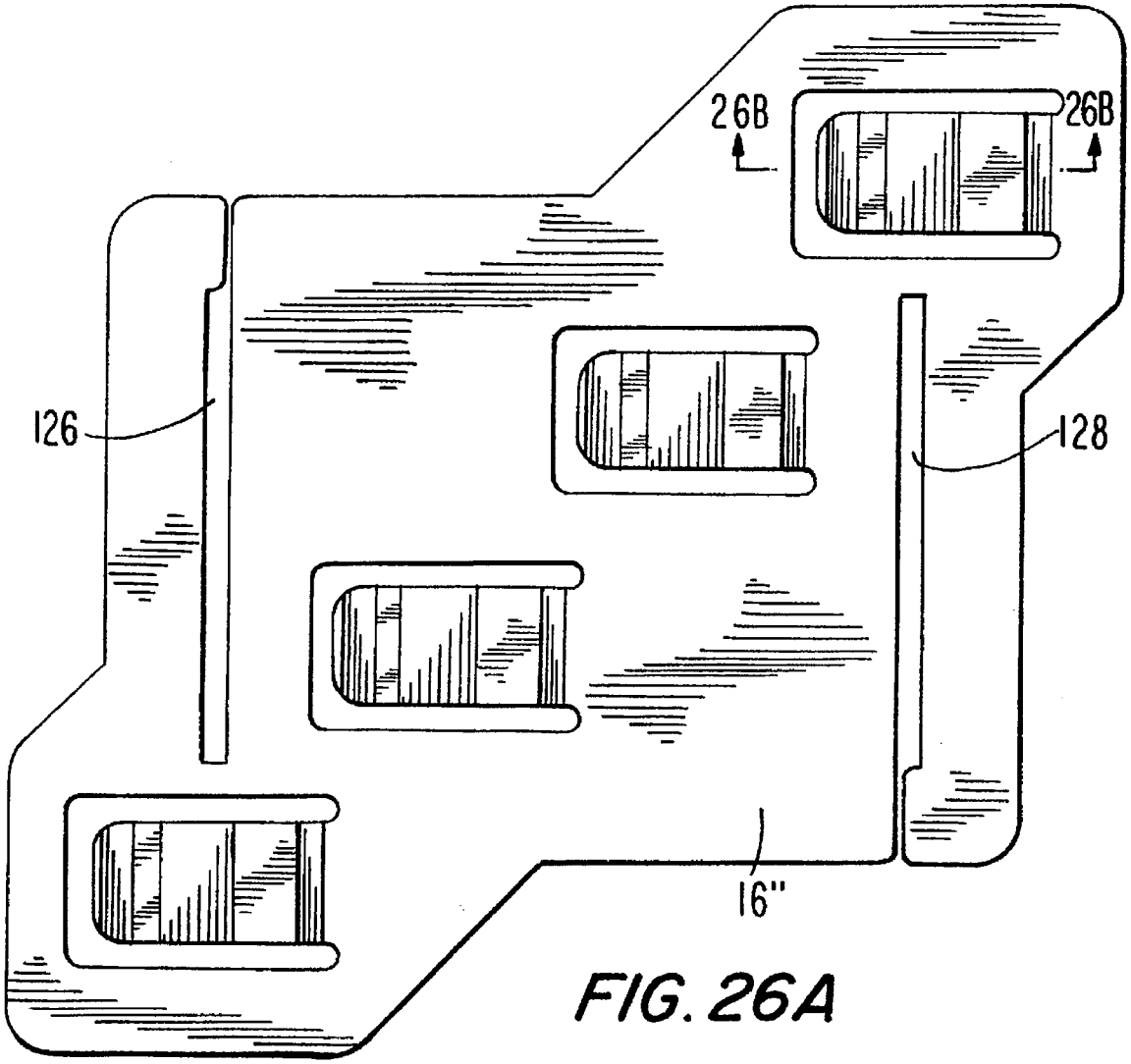

FIGS. 25A–26B illustrate two alternate embodiments of the pleating member 16', 16", respectively. The embodiment illustrated in FIGS. 25A and 25B can be slipped onto band 12 through the use of a pair of T-shaped slots 122 and 124. Alternatively, as illustrated in FIGS. 26A and 26B, the pleating member 16" can be attached to the band 12 by straight slotted members 126, 128.

The present invention has been described by reference to "furniture" and this term is to be construed broadly to include, for example, a bed, a sculpture base, a table (which are often used at trade show exhibits) or virtually any other interior architectural structure. Additionally, the pleating member could be directly attached to a wall, a stage or any other dressable surface without the use of band 12. The attachment could be achieved by using, for example, self-adhesive tape or perhaps by fastener members such as screws.

Having described the presently preferred exemplary embodiment of a new and improved device for shaping and maintaining the position of skirts and covers on seating and upholstered furniture, it is believed that other variations, modifications and changes will be suggested to those skilled in the art. It is, therefore, to be understood that all such variations, modifications, and changes are believed to fall within the scope of the present invention as defined by the appended claims.

What we claim is:

1. A device for maintaining the position of a furniture cover on seating and furniture comprising:

an elongated elastic band, said band being adapted to be placed about said furniture;

a pleating member having means for being affixed to said elongated band, said pleating member having non-piercing clip means for gathering and maintaining the position of material of a furniture cover; and a band adjusting member connected to said elastic band so that said band will form a closed loop of a predetermined length around the furniture, said band adjusting member having means for adjusting a length of said closed loop.

2. A device according to claim 1, further comprising a skirt clip having means for being connected to said elongated band, and means for affixing a skirt to said elongated band.

3. A device according to claim 1, further comprising a corner fabric gathering member having means for being connected to said elongated band, said corner fabric gathering member having means for gathering material of a furniture cover.

4. A device for maintaining the position of a skirt on seating and furniture comprising:

an elongated elastic band, said band being adapted to be placed about said furniture;

a skirt clip connected to said elongated band for holding a skirt over said band; and a band adjusting member connected to said elastic band so that said band will form a closed loop of a predetermined length around the furniture, said band adjusting member having means for adjusting a length of said closed loop.

5. A device according to claim 4, further comprising a pleating member having means for being affixed to said elongated band, and means for gathering material of a furniture cover.

6. A device according to claim 4, further comprising a corner fabric gathering member having means for being affixed to said elongated band and means for gathering material of a furniture cover.

7. A device for maintaining the position of a furniture cover on seating and furniture comprising:

an elongated elastic band being formed into a closed loop, said band being adapted to be placed about said furniture, said elongated band having a first end and a second end;

a pleating member having means for being affixed to said elongated band, said pleating member having means for gathering and maintaining the position of material of a furniture cover; and a band adjusting member for joining said first end and said second end of said band so that said band will form a closed loop of a predetermined length, said band adjusting member having means for adjusting a length of said closed loop.

8. A device according to claim 7, wherein said band adjusting member is substantially planar.

9. A device according to claim 8, wherein said band adjusting member includes at least two U-shaped slots.

10. A device according to claim 9, wherein said band adjusting member adjusting means includes at least two T-shaped slots.

11. A device according to claim 7, further comprising a skirt clip having means for being connected to said elongated band, and means for affixing a skirt to said elongated band.

12. A device according to claim 11, further comprising a corner fabric gathering member having means for being connected to said elongated band, said corner fabric gathering member having means for gathering material of a furniture cover.

13. A device according to claim 12, wherein said corner fabric gathering member includes a clip.

14. A device according to claim 11, wherein said skirt clip has at least one downwardly depending finger.

15. A device according to claim 14, wherein said skirt clip includes at least one U-shaped slot and at least one downwardly depending finger.

16. A device according to claim 7, wherein said pleating member includes a plurality of clips.

17. A device according to claim 16, wherein said pleating member includes at least two V-shaped slots.

18. A skirt clip for maintaining and shaping the position of skirts to be held on a band around furniture, said skirt clip comprising:

a substantially planar body, said body having one end with a pair of fingers made of transparent material, said fingers protruding outwardly from said body on opposite sides of said one end of said body, said body having an opposite end containing a U-shaped slot with a pair of legs extending away from said one end, said fingers defining a recess for receiving an upper edge of the band and said U-shaped slot being positioned on the body for receiving a lower edge of the band.

19. A device for maintaining the position of a skirt on seating and furniture comprising:

an elongated elastic band being formed into a closed loop, said band being adapted to be placed about said furniture, said elongated band having a first end and a second end;

a skirt clip connected to said elongated band; and a band adjusting member for joining said first end and said second end of said band so that said band will form a closed loop of a predetermined length, said band adjusting member having means for adjusting a length of said closed loop.

20. A device according to claim 19, wherein said band adjusting member is substantially planar.

21. A device according to claim 20, wherein said band adjusting member includes at least two U-shaped slots.

22. A device according to claim 21, wherein said band adjusting member includes at least two T-shaped slots.

23. A device according to claim 19, wherein said skirt clip includes at least one downwardly depending finger.

24. A device according to claim 23, wherein said skirt clip includes at least one U-shaped slot and at least one downwardly depending finger.

25. A device according to claim 19, further comprising a pleating member having means for being affixed to said elongated band, and means for gathering material of a furniture cover.

26. A device according to claim 25, further comprising a corner fabric gathering member having means for being affixed to said elongated band and means for gathering material of a furniture cover.

27. A device according to claim 26, wherein said corner fabric gathering member gathering means includes a clip.

28. A device according to claim 25, wherein said pleating member includes a plurality of clips.

29. A device according to claim 28, wherein said pleating member includes at least two V-shaped slots.

* * * * *